US005881741A

United States Patent [19]

Chen

[11] Patent Number: 5,881,741

[45] Date of Patent: Mar. 16, 1999

[54] HAIR HOLDER AND ASSEMBLING METHOD THEREFOR

[76] Inventor: Chin-Chin Chen, No. 48 Dwan Ming St., Hsiaokang Dist., Kaohsiung, Taiwan

[21] Appl. No.: 84,086

[22] Filed: May 26, 1998

[51] Int. Cl.[6] ..... A45D 8/20

[52] U.S. Cl. ..... 132/277; 132/279; 132/282; 132/132; 132/156

[58] Field of Search ..... 132/277, 275, 132/276, 278, 279, 282, 132, 133, 134, 138, 151, 156

[56] References Cited

U.S. PATENT DOCUMENTS 5,642,740 7/1997 Chen ..... 132/277
5,735,296 4/1998 Chen ..... 132/277

*Primary Examiner*—Gene Mancene
*Assistant Examiner*—Pedro Philogene
*Attorney, Agent, or Firm*—Larson & Taylor

[57] ABSTRACT

A method is provided for assembling a hair holder. Firstly, two bodies interconnected by a connecting plate are integrally formed, wherein each body includes two lugs with aligned holes and a plurality of bristle elements formed thereon, and wherein each of two ends of the connecting plate is connected to an associated body by a first bendable section. The connecting plate further includes a second bendable section formed on a mediate section thereof. Then, two legs of an elastic member are attached to two protrusions of the connecting plate to temporarily position the elastic member. Next, the bodies are bent along the first bendable sections to align the holes of the lugs with a coil portion of the elastic member. A pivotal pin is then extended through the aligned holes of the lugs and the coil portion of the elastic member. Next, the legs of the elastic member are disengaged from the protrusions.

4 Claims, 3 Drawing Sheets

HAIR HOLDER AND ASSEMBLING METHOD THEREFOR

BACKGROUND OF THE INVENTION

1. Field of the Invention

The present invention relates to a hair holder and a method for assembling the hair holder.

2. Description of the Related Art

U.S. Pat. No. 5,642,740 issued on Jul. 1, 1997 to Applicant discloses a hair holder which has a cover plate to shield the spring for aesthetic purpose as well as safety purpose. U.S. Pat. No. 5,735,296 issued on Apr. 7, 1998 also to Applicant discloses a hair holder to reduce the time required for assembling the cover plate of the hair holder. The present invention is intended to provide an improved design that may save the time required for assembling the whole hair holder.

SUMMARY OF THE INVENTION

A hair holder in accordance with the present invention comprises a pair of bodies interconnected by a connecting plate. Each body includes a pair of lugs having aligned holes. Each body further includes a plurality of bristle elements for engaging with hair. Each of two ends of the connecting plate is connected to an associated body by a first bendable section formed therebetween. The connecting plate further includes a second bendable section formed on a mediate section thereof to allow the connecting plate to be bendable. A pivotal pin is extended through the aligned holes of the lugs of the bodies. An elastic member includes a coil portion mounted between the lugs and around the pivotal pin. The elastic member further includes two legs respectively attached to the bodies to bias the bristle elements of one of the bodies toward the bristle elements of the other of the bodies. The connecting plate is disengagable from the bodies by breaking along the first bendable sections The present invention further provides a method for assembling a hair holder. Firstly, two bodies interconnected by a connecting plate are integrally formed, wherein each body includes two lugs with aligned holes and a plurality of bristle elements formed thereon, and wherein each of two ends of said connecting plate is connected to an associated said body by a first bendable section. The connecting plate further includes a second bendable section formed on a mediate section thereof. The connecting plate further includes two protrusions formed thereon. Then, two legs of an elastic member are attached to the two protrusions of the connecting plate to temporarily position the elastic member. Next, the bodies are bent along the first bendable sections to align the holes of the lugs with a coil portion of the elastic member. A pivotal pin is then extended through the aligned holes of the lugs and the coil portion of the elastic member. Next, the legs of the elastic member are disengaged from the protrusions. The connecting plate may be disengaged from the bodies by breaking along the first bendable sections.

By means of the method, it is appreciated that the hair holder can be manufactured by a single mold to reduce the mold cost. In addition, the time required for assembly is relatively short, which further reduces the cost.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
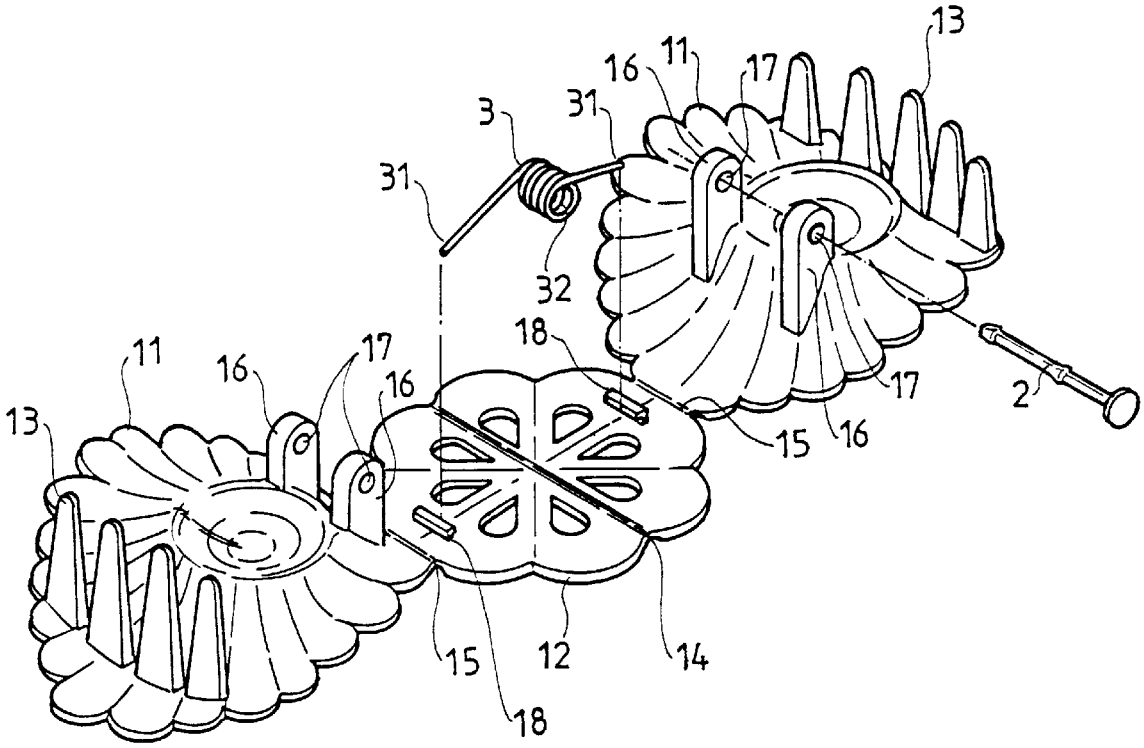
FIG. 1 is a perspective view of a hair holder, in a flattened status before assembly, in accordance with the present invention.

FIG. 1 illustrates a hair holder that is preferably made of injection molding from a single mold. The hair holder is in a flattened status before assembly. The hair holder includes a pair of bodies 11 interconnected by a connecting plate 12. Each body 11 includes a pair of lugs 16 formed on a first end thereof adjacent to the connecting plate 12. The lugs 16 have aligned holes 17, which can be extended by a pivotal pin 2 so as to pivotally, connect the bodies together. Each body 11 further includes a number of teeth or bristle elements 13 formed on a second end thereof for engaging with hair. The body 11 may be of any desired shape and have any desired patterns thereon.

As shown in FIG. 1, each of two ends of the connecting plate 12 is connected with the associated body 11 by a first bendable section 15 which allows the connecting plate 12 and the associated body 11 to bend relative to each other. Each end of the connecting plate 12 further includes a protrusion 18 formed thereon and adjacent to the associated bendable section 15. The connecting plate 12 further includes a second bendable section 14 formed in a mediate section thereof An elastic member 3, preferably a coil spring, is provided to bias the bristle elements 13 on one of the bodies 11 toward the bristle elements 13 on the other body 11. The coil spring 3 includes a coil portion 32 through which the pivotal pin 2 extends and two legs 31.

Figure 2:
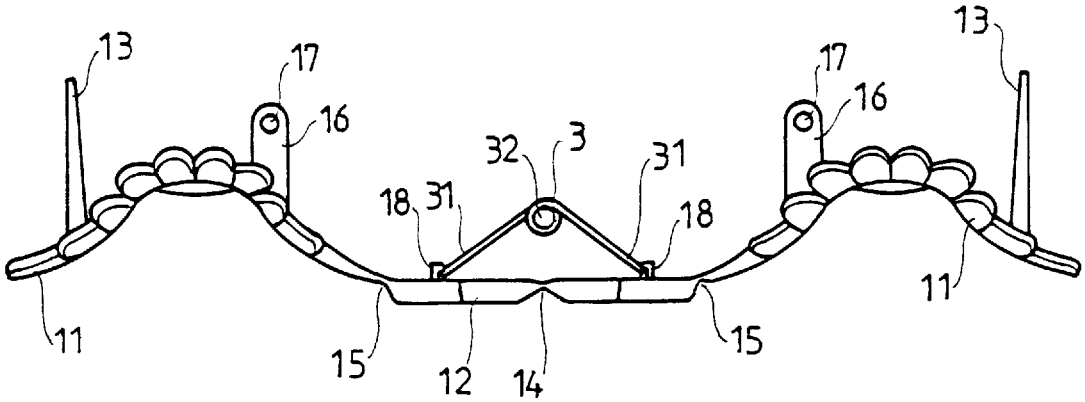
FIGS. 2 to 6 are side views illustrating assembly of the hair holder in accordance with the present invention.
Figure 3:
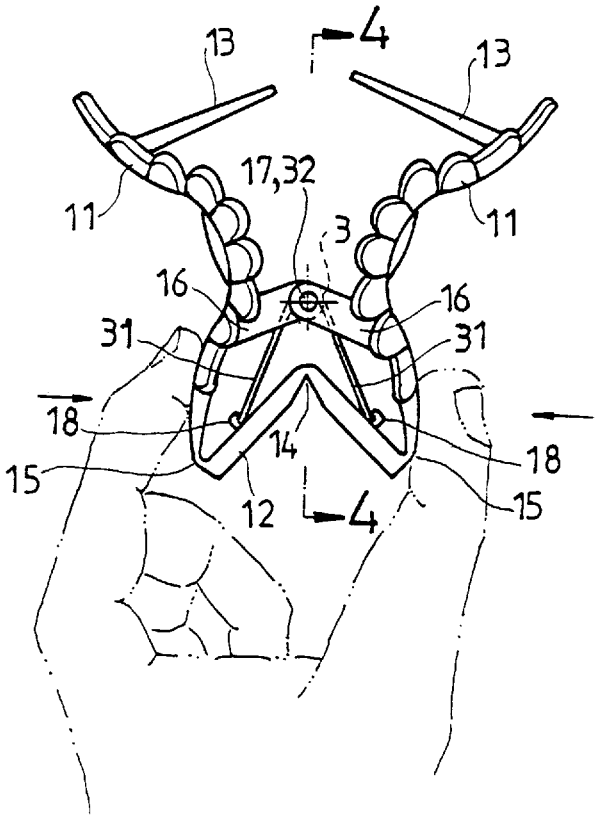
Figure 4:
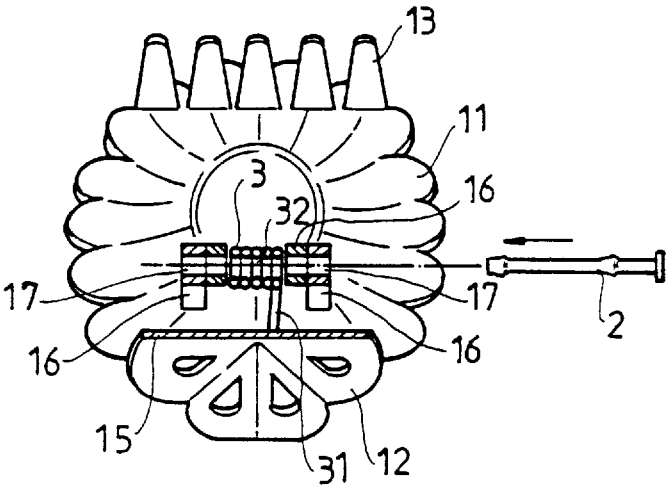
Figure 5:
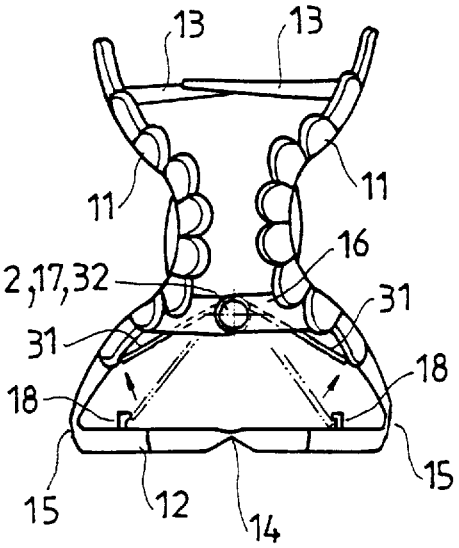
Figure 6:
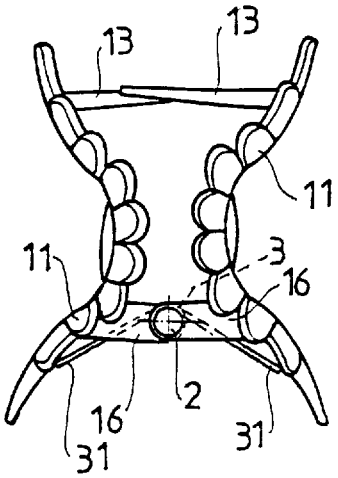

In assembly, referring to FIG. 2, the legs 31 of the coil spring 3 are respectively attached to the protrusions 18 to temporarily position the coil spring 3 on the connecting plate 12. Next, the bodies 11 are moved toward each other by means of bending the connecting plate 12 along the bendable sections 14 and 15 until the holes 17 on the lugs 16 align with each other and align with the coil portion 32 of the coil spring 3, as shown in FIG. 3. Then, the pivotal pin 2 is extended through the aligned holes 17 of the lugs 16 and the coil portion 32 of the coil spring 3, as shown in FIG. 4. Next, as shown in FIG. 5, the legs 31 are disengaged from the protrusions 18 by, e.g., a small rod. If necessary, the cover plate 12 can be detached by means of cutting or breaking along the bendable sections 15.

According to the above description, it is appreciated that the hair holder can be manufactured by a single mold to reduce the mold cost (the conventional hair holder requires several molds). In addition, the time required for assembly is relatively short, which further reduces the cost.

Although the invention has been explained in relation to its preferred embodiment, it is to be understood that many other possible modifications and variations can be made without departing from the spirit and scope of the invention as hereinafter claimed.

What is claimed is:

1. A hair holder, comprising:

a pair of bodies, each said body including a pair of lugs having aligned holes, each said body further including a plurality of bristle elements for engaging with hair;

a connecting plate interconnected between the bodies, the connecting plate including two ends each of which is connected to an associated said body by a first bendable section formed therebetween, the connecting plate further including a second bendable section formed on a mediate section thereof to allow the connecting plate to be bendable;

a pivotal pin extended through the aligned holes of the lugs of the bodies; and an elastic member including a coil portion mounted between the lugs and around the pivotal pin, the elastic member further including two legs respectively attached to the bodies to bias the bristle elements of one of the bodies toward the bristle elements of the other of the bodies.

2. The hair holder according to claim 1, wherein the connecting plate is disengagable from the bodies by breaking along the first bendable sections.

3. A method for assembling a hair holder, comprising the following steps of:

(a) integrally forming two bodies interconnected by a connecting plate, each said body including two lugs with aligned holes and a plurality of bristle elements formed thereon, each of two ends of said connecting plate being connected to an associated said body by a first bendable section, said connecting plate further including a second bendable section formed on a mediate section thereof, said connecting plate further including two protrusions formed thereon;

(b) attaching two legs of an elastic member to the two protrusions of the connecting plate to temporarily position the elastic member;

(c) bending the bodies along the first bendable sections to align the holes of the lugs with a coil portion of the elastic member;

(d) extending a pivotal pin through the aligned holes of the lugs and the coil portion of the elastic member; and (e) disengaging the legs of the elastic member from the protrusions.

4. The method according to claim 3, further comprising a step of:

(f) disengaging the connecting plate from the bodies by breaking along the first bendable sections.

* * * * *